US006213801B1

(12) United States Patent
Tayloe et al.

(10) Patent No.: US 6,213,801 B1
(45) Date of Patent: Apr. 10, 2001

(54) ELECTRICAL COUPLING AND SWITCHING DEVICE WITH FLEXIBLE MICROSTRIP

(75) Inventors: David C. Tayloe, Rock Hill, SC (US); Jim Kennedy, Charlotte; Steve Bateman, Waxhaw, both of NC (US)

(73) Assignee: Kings Electronics Co., Inc., Rock Hill, SC (US)

( * ) Notice: Subject to any disclaimer, the term of this patent is extended or adjusted under 35 U.S.C. 154(b) by 0 days.

(21) Appl. No.: 09/544,889

(22) Filed: Apr. 7, 2000

(51) Int. Cl.[7] ..... H01R 29/00
(52) U.S. Cl. ..... 439/188; 439/944
(58) Field of Search ..... 439/188, 944

(56) References Cited

U.S. PATENT DOCUMENTS

| | | | | |
|---|---|---|---|---|
| 4,757,163 | | 7/1988 | Rabey et al. . | |
| 4,782,313 | * | 11/1988 | Brant, Jr. | 333/246 |
| 4,815,104 | | 3/1989 | Williams et al. . | |
| 4,975,066 | | 12/1990 | Sucheski et al. . | |
| 5,147,992 | | 9/1992 | Eriksen et al. . | |
| 5,246,378 | | 9/1993 | Seiceanu . | |
| 5,280,254 | | 1/1994 | Hunter et al. . | |
| 5,382,173 | | 1/1995 | Brown et al. . | |
| 5,631,446 | * | 5/1997 | Quan | 174/254 |
| 5,702,262 | | 12/1997 | Brown et al. . | |
| 5,882,217 | | 3/1999 | Aponte et al. . | |
| 5,885,096 | | 3/1999 | Ogren . | |
| 5,893,767 | | 4/1999 | Broschard, III . | |
| 5,904,579 | | 5/1999 | McLean et al. . | |
| 5,964,607 | | 10/1999 | Finke et al. . | |
| 5,965,935 | * | 10/1999 | Bahl et al. | 257/664 |
| 6,045,378 | * | 4/2000 | Follingstad | 439/188 |

* cited by examiner

*Primary Examiner*—Paula Bradley
*Assistant Examiner*—Ann McCamey
(74) *Attorney, Agent, or Firm*—Alston & Bird LLP

(57) ABSTRACT

An electrical coupling and switching device and associated method advantageous for use with signal bandwidths of 1.5 GHz or more is provided having a housing defining first and second equipment ports for use with coaxial plugs. The housing also defines first and second patch ports for receiving patch plugs, such as video-style plugs. A pair of actuators are positioned within the housing for establishing electrical communication between the equipment ports and a corresponding patch plugs. A flexible microstrip is also provided that, in a normal mode, provides a low return loss, low discontinuity flowpath between the equipment ports, while in a patched mode is flexibly urged away from an equipment port that is patched to the corresponding patch plug via the actuator such that the unpatched equipment port is terminated in its characteristic impedance.

10 Claims, 3 Drawing Sheets

ELECTRICAL COUPLING AND SWITCHING DEVICE WITH FLEXIBLE MICROSTRIP

FIELD OF THE INVENTION

The present invention relates to electrical connectors, and more particularly to electrical coupling and switching devices for use in high frequency transmission rate applications.

BACKGROUND OF THE INVENTION

Electrical connectors and switching devices have been used for many years in various industries, such as the broadcast industry. The devices are used in electrical equipment systems to provide a transfer of electrical signal to different components of the particular system. The devices typically employ a mechanical-type action, such as a biasing action, in order to connect or disconnect various components of the system.

For example, a common type of connector and switching device or jack employs spring arms that are normally biased to provide electrical communication between two equipment plugs, such as standard BNC plugs, that are engaged in the device, typically on the same end of the device. The spring arms are individually moveable away from the normally biased position such that the equipment plugs can be terminated separately. In particular, a patch plug is often provided for urging a respective spring arm away from the normally biased position such that the patch plug is in electrical communication with one of the equipment plugs, while the remaining equipment plug is terminated through a resistor via the remaining spring arm.

Typically, these conventional jacks perform satisfactorily for standard television signals or for serial digital signals having a maximum bandwidth of about 750 megahertz. More specifically, the signal loss and discontinuity associated with these conventional jacks are not deleterious for most applications because most applications in the broadcast field for which they were designed do not require a high level of performance. However, with the advent of high definition television and other formats where the operating bandwidth is now beyond 2.4 gigahertz, conventional jacks do not provide effective signal carrying capacity as required for these applications. In particular, conventional jacks have excessive return losses at these high bandwidths. Thus, there is a need for an electrical switching jack that provides low discontinuity while minimizing return loss at bandwidths of about 1.5 GHz and higher. The jack, however, must be durable and capable of withstanding the repetitious cycling of the equipment and patch plugs.

SUMMARY OF THE INVENTION

These and other needs are provided by the present invention, which, in one embodiment, comprises an electrical coupling and switching device having a low-discontinuity, impedance-controlled electrical flowpath between two equipment plugs along a flexible microstrip. Advantageously, the flexible microstrip can be moved by insertion of a patch plug into the device in order to break the connection between the equipment plugs and establish electrical communication between the patch plug and the corresponding equipment plug.

In particular, the electrical coupling and switching device or jack in one embodiment comprises a housing defining first and second equipment ports, wherein each port includes a conductor pin. The conductor pins are adapted for connecting to the center conductor of a equipment plug, such as a coaxial or BNC plug, which is inserted into the respective equipment port. The housing further defines first and second patch ports for receiving first and second patch plugs, such as video-style plugs.

The jack also includes first and second insulative actuators positioned within the housing. Each actuator includes a conducting member that is positioned to be engaged by a patch plug when the patch plug is inserted into the respective patch port. The conducting member is also positioned such that as the patch plug is fully inserted into the respective patch port, the conducting member contacts the conductor pin of the respective equipment port so as to establish electrical communication or connection between the patch plug and the equipment port.

Advantageously, the flexible microstrip has first and second portions that, in a normal mode, are biased into contact with the conductor pins of the first and second equipment ports, respectively. In this regard, a connection is made between the first and second equipment ports when no patch plugs are inserted into the patch ports. More specifically, an impedance-controlled electrical flowpath is established along the flexible microstrip between the first and second equipment plugs in the normal mode, i.e., when no patch plugs are inserted into the patch ports.

When a patch plug, such as a video plug, is inserted into one of the patch ports, the patch plug engages the respective insulative actuator. As the patch plug engages the patch port, the actuator is urged toward the respective equipment port. This action causes the actuator to engage and urge the respective portion of the flexible microstrip away from and out of contact with the conductor pin on the respective equipment port, thus creating a patched circuit between the patch plug and the respective equipment port and an unpatched circuit to the remaining equipment port. Preferably, the actuator includes a ramped or angled surface for gradually engaging the respective portion of the flexible microstrip.

In one embodiment, the jack of the present invention also includes a resistive termination device, such as a resistor, that is positioned inside the housing so as to be contacted by the flexible microstrip when one of the insulative actuators urges the respective portion of the microstrip out of contact with the conductor pin of the respective equipment port. As the flexible microstrip contacts the termination device, the remaining unpatched equipment port is thereby terminated. In addition, the termination device preferably has the same impedance as the unpatched circuit, thereby substantially eliminating return loss. In order to facilitate contact between the termination device and the flexible microstrip, a conductive tab portion is attached to the flexible microstrip at each of its respective ends.

Thus, the jack of the present invention overcomes the problems mentioned above. In particular, the coaxial-to-flexible microstrip transition provides a more constant impedance in the normal mode than conventional jacks which employ spring arms to carry the signal between the equipment ports. In addition, the jack provides a low discontinuity flowpath between the equipment ports in the normal mode, which results in better signal integrity, particularly at bandwidths of 1.5 GHz and greater.

BRIEF DESCRIPTION OF THE DRAWINGS

While some of the objects and advantages of the present invention have been stated, others will appear as the description proceeds when taken in conjunction with the accompanying drawings, which are not necessarily drawn to scale, wherein.

DETAILED DESCRIPTION OF THE INVENTION

Figure 1:
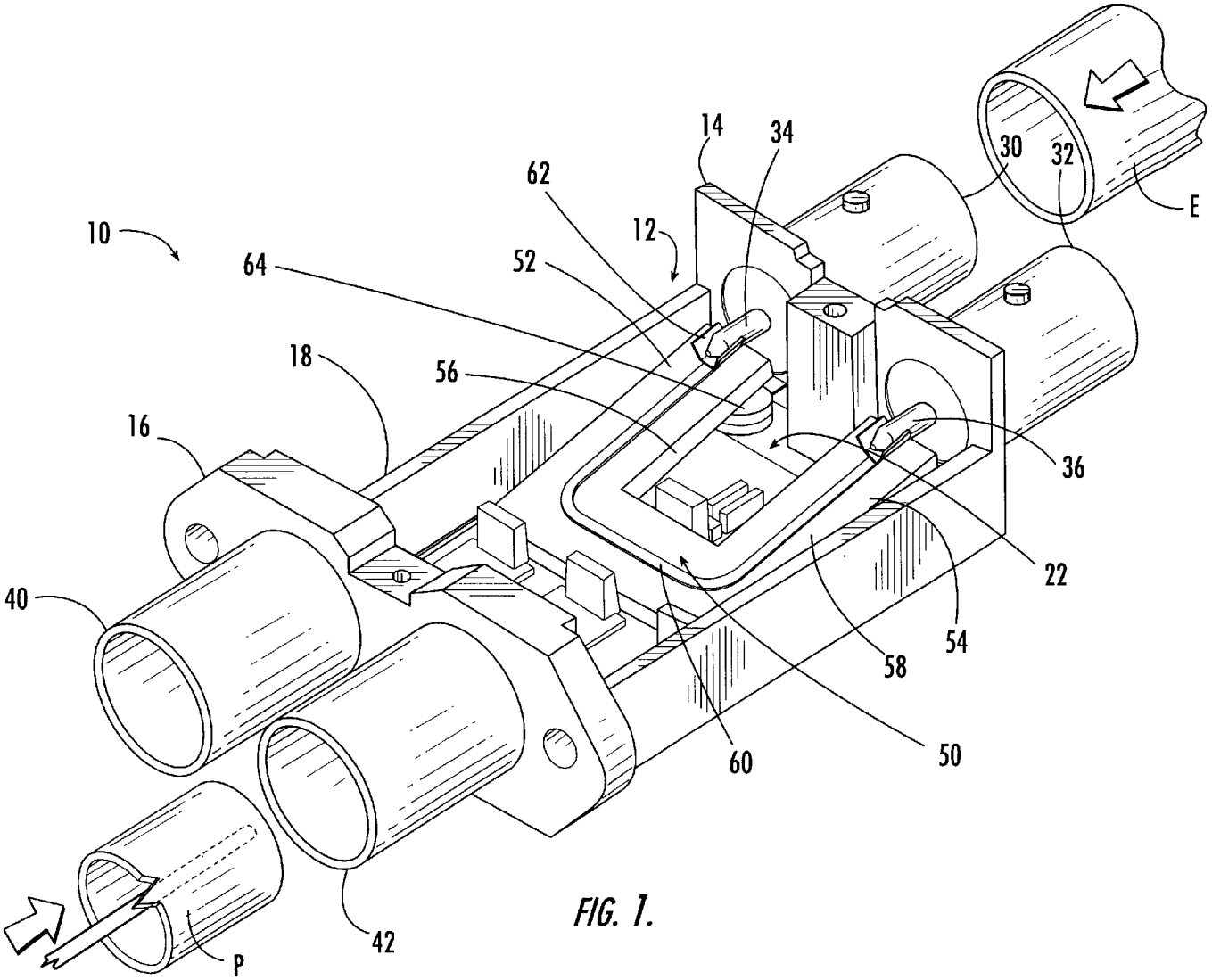
FIG. 1 is a perspective view of a portion of an electrical coupling and switching device according to one embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Turning to FIGS. 1–4, an electrical coupling and switching device or jack according to the present invention is generally designated by the numeral 10. The jack 10 may be used in many different applications, but is particularly advantageous for use in high bandwidth applications, such as high definition television or other applications with bandwidths of 1.5 GHz or greater. In particular, the jack 10 comprises a housing 12 made from a die cast conductive material, such as nickel plated zinc, including a front wall 14, a back wall 16, and side walls 18. The walls, 14, 16, 18 cooperate with a bottom wall 20 and a cover (not shown) to define a housing interior 22. In one embodiment, the housing has a length of about 34 inches, a width of about 1.5–2.5 inches, and a thickness of about 0.5–1.0 inches.

The front wall 14 defines two equipment ports 30, 32 to receive coaxial plugs, such as standard BNC-style plugs E (only one shown) having a center conductor surrounded by an outer sleeve. The equipment ports 30, 32 include conductor pins 34, 36, respectively, that extend into the housing interior 22. The conductor pins 34, 36 are positioned such that the center conductors of respective coaxial equipment plugs E engage the conductors pins and establish electrical communication therewith. Although the conductor pins 34, 36 are shown as having a generally circular cross section, the conductor pins can have other shapes and dimensions. The equipment ports 30, 32 also engage the outer sleeves of the coaxial plugs in order to connect the outer sleeves to an electrical ground.

Figure 3:
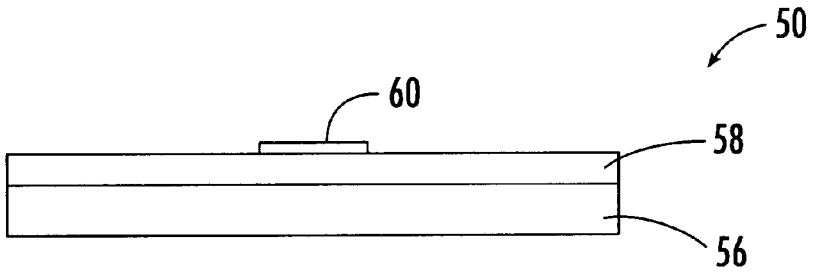
FIG. 3 is a cross-sectional view of a flexible microstrip according to the present invention.

The jack 10 also includes a flexible microstrip 50 having first and second portions 52, 54 that is positioned within the housing interior 22 proximate the front wall 14. As shown in FIG. 3, the flexible microstrip 50 comprises a ground element 56, a dielectric layer 58, and a conducting track 60 extending along an upper surface of the dielectric layer. Desired impedance of the microstrip 50 can be controlled by the thickness of the dielectric layer 58, the dielectric constant of the dielectric layer, and the width of the conducting track 60. More specifically, the microstrip 50 can be formed via flexible printed circuit board technology or by interposing a highly flexible, homogenous, isotropic polymeric sheet, such as polytetrafluoroethylene (PTFE), between two metal sheets, which can be formed from brass, copper, or other conductive metal. In one advantageous embodiment, the ground element 56 comprises a resiliently flexible conductive material, such as beryllium copper. The dielectric layer 58 is also highly flexible. As such, the microstrip 50 is resiliently flexible, and can withstand a minimum of 30,000 flexure cycles, as discussed more fully below.

In a normal mode, an electrical circuit is established from one equipment port to the other equipment port via the flexible microstrip. In particular, the electrical circuit, which in one embodiment has a characteristic impedance of 75 Ohms, is established by directing an electrical signal from one equipment plug, through the respective equipment port 30 and conductor pin 34 to the flexible microstrip 50. The signal is further directed along the conducting track 60 of the microstrip to the conductor pin 36 of the other equipment port 32, which is in electrical communication with the other equipment plug. In order to maintain a continuous ground plane, the microstrip 50 should make sufficient contact with the equipment ports 30, 32. To facilitate this contact, a grounding device (not shown) is provided between the ground element of the microstrip and the housing 12 proximate the wall 14.

A conductive tab portion 62 is secured to each end of the microstrip 50 for facilitating positive contact between the microstrip and the conductor pins 34, 36. In addition, each conductive tab portion 62 is wrapped around the respective end of the microstrip 50 so that the signal along the conducting track 60 is carried to the opposite surface of the microstrip for engagement with a resistive termination device 64, as discussed more fully below. Advantageously, the conductive tab portion 62 in conjunction with the flexible microstrip 50 substantially eliminates discontinuity between the equipment ports 30, 32.

The back wall 16 defines two patch ports 40, 42 adapted to receive patch plugs P (only one shown). In one embodiment, the patch ports 40, 42 are adapted to receive coaxial video-style patch plugs, although other types of patch plugs may also be used. The patch ports 40, 42 are formed in a conventional manner for releasably securing the patch plugs to the jack 10, and define openings so that the patch plugs can extend therethrough into the housing interior 22.

Figure 2:
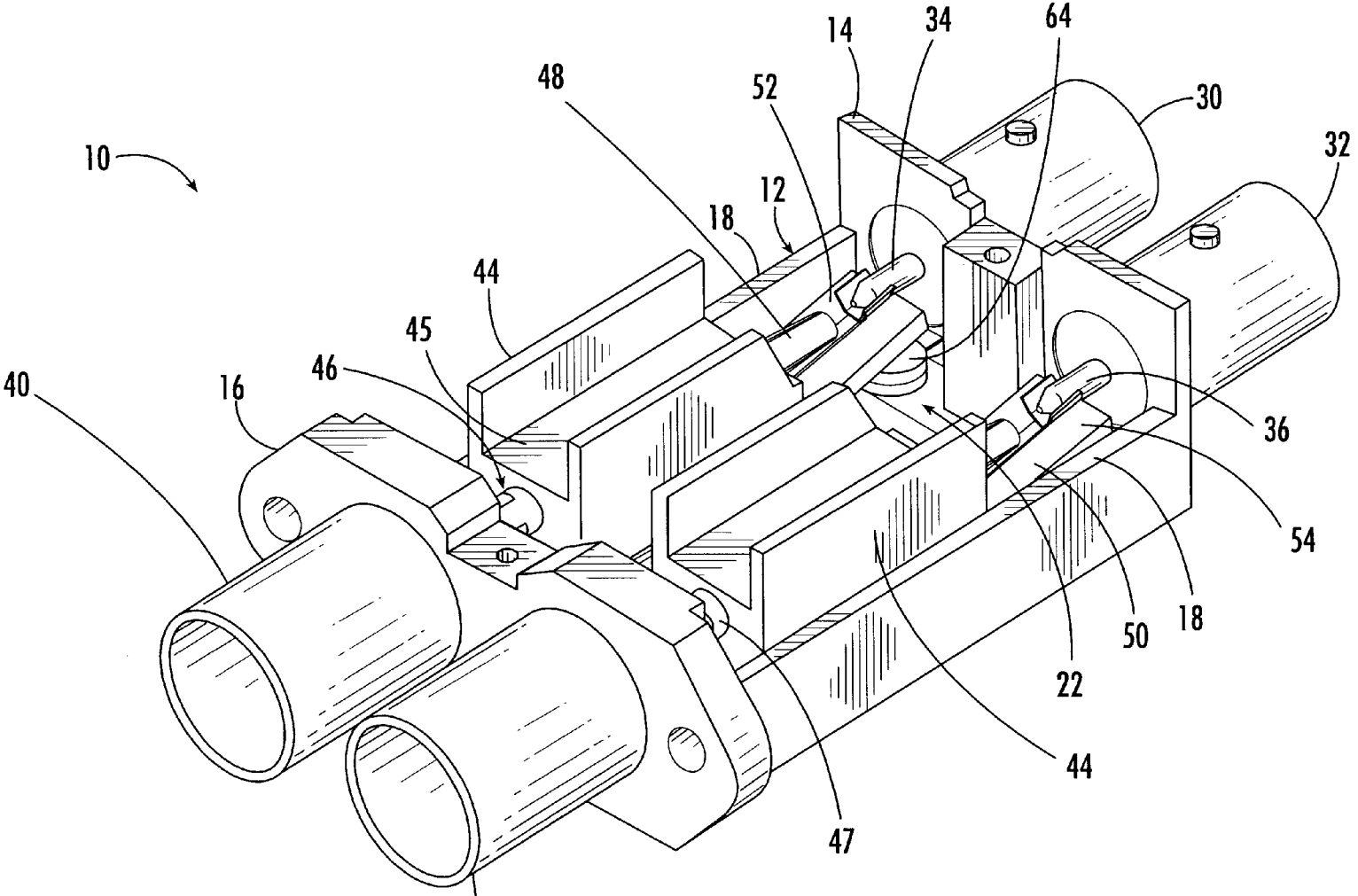
FIG. 2 is a perspective view of a portion of an electrical coupling and switching device according to the present invention showing a pair of insulative actuators.
Figure 4:
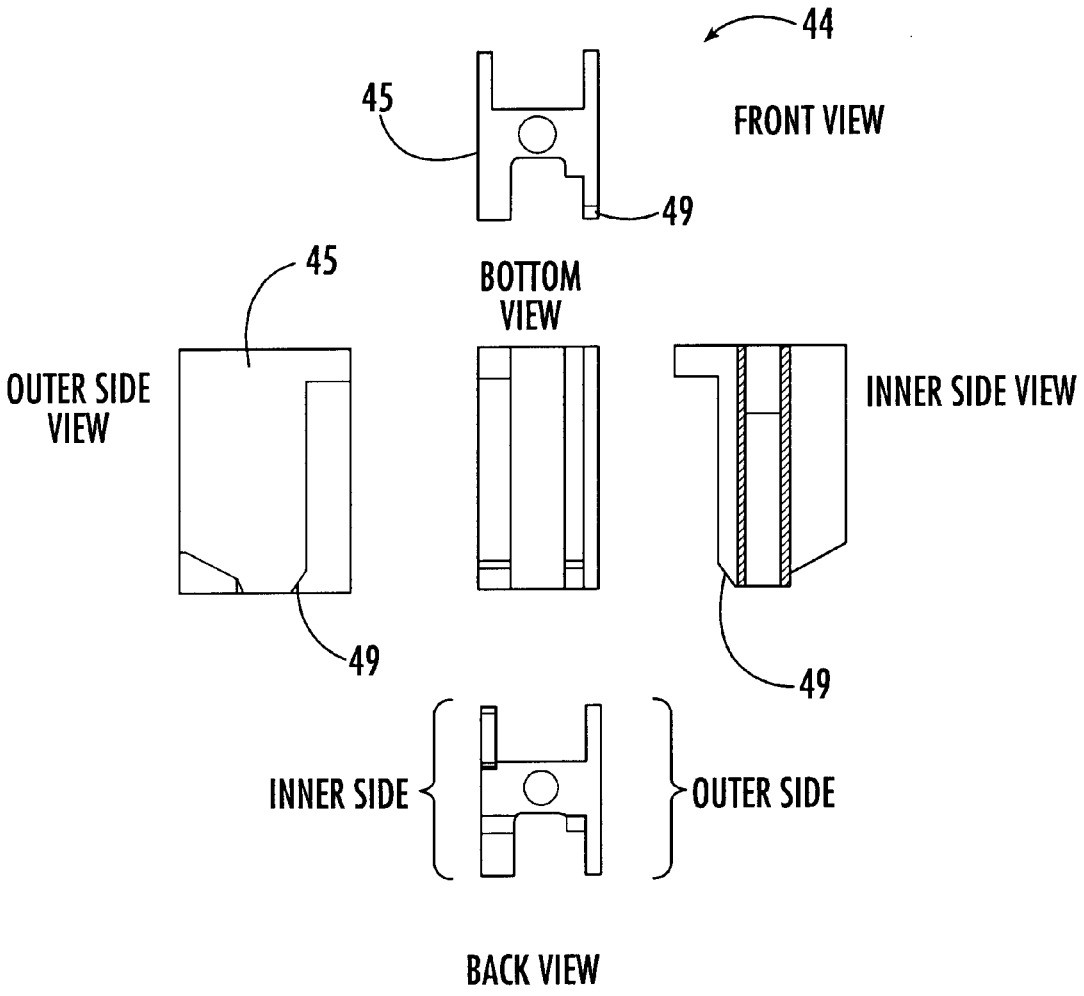
FIG. 4 shows several views of an insulative actuator according to the present invention.

As shown in FIGS. 2 and 4, the jack 10 also includes a pair of insulative actuators or shuttles 44 that are movably disposed in the housing interior 22. In particular, the shuttles 44 have a body portion 45 formed of a lubricious, insulative material, such as acetal resin. Suitable acetal resins are available from DuPont under the Delrin® trademark. Other materials may also be used, such as PTFE. In addition, the shuttles 44 include a conducting portion or member 46 extending therethrough. In should be noted, however, that the conducting member 46 does not have to extend through the body portion 45, but instead could extend around the body portion in the shape of a full or partial band without parting from the spirit and scope of the present invention. The conducting member 46 includes a patch plug contact 47 for engaging the respective patch plug and a socket 48 or the like for engaging the conducting pins 34, 36 of the respective equipment ports. In one embodiment, the shuttles 44 may include a bias member (not shown), such as a spring, in order to hold the shuttles in a position proximate the back wall 16 unless acted upon by a sufficient external force. The bias member should also be capable of returning the shuttle to a fully disengaged position proximate the back wall. The body portion 45 of the shuttle 44 generally has an "H" shape that facilitates movement along the housing interior 22, although other shapes may also be used. More specifically, the shape of the shuttle 44 allows suitable cooperation with the bottom wall 20 and the cover of the housing to form a "track and rail" system along the housing interior 22 of the jack 10. This design ensures minimal wear on the jack components and maintains proper alignment between the shuttles 44 and the equipment ports 30, 32.

In a patched mode, a video-style patch plug P is inserted into a particular patch port, such as the patch port designated by the numeral 40. This may be desirable if there is a need to patch around a particular piece of equipment connected to the jack 10 at one of the equipment ports, such as the equipment port designated by the numeral 32. As the patch plug is fully seated into the patch port 40, the patch plug urges or pushes the shuttle 44 towards the respective equipment port 30, which preferably is located across the interior portion 22 of the housing 12 along a common longitudinal axis with the patch port 40. As the shuttle 44 is urged toward the equipment port 30, the shuttle 44 engages the flexible microstrip 50. In one embodiment, the body portion 45 of the shuttle 44 includes an angled or ramped bottom surface 49 substantially corresponding to the angle of the flexible microstrip 50 when the microstrip is in the normal mode in order to facilitate gradual engagement therebetween. As such, as the shuttle 44 moves towards the respective equipment port 30, the shuttle progressively engages the first portion 52 of the flexible microstrip 50 and urges the first portion of the microstrip away from the respective conductor pin 34. When the patch plug is fully seated in the patch port 40, the socket 48 extending from the shuttle 44 engages and mates with the conductor pin 34 extending from the corresponding equipment port 30. As a result, an electrical patch circuit is established between the patch plug and the equipment port 30 via the shuttle 44, cover, and conductor pin 34. Advantageously, the patch circuit provides a constant impedance for the patched signal.

According to one embodiment of the present invention, the unpatched equipment port 32 is terminated in its characteristic impedance while the shuttle 44 moves toward the corresponding equipment port 30 and urges the first portion 52 of the flexible microstrip 50 away from the conductor pin 34. More specifically, as the patch plug is fully seated in the patch port 40 and the socket 48 has engaged the conductor pin 34, the tab portion 62 connected to the flexible microstrip 50 proximate the first portion 52 thereof is urged away from the conductor pin 34 and contacts the resistive termination device 64.

As shown in FIGS. 1 and 2, the resistive termination device 64 comprises a resistor of the same value as the characteristic impedance of the system, such as 75 Ohms. There is a contact for the termination device 64 beneath each portion 52 and 54 of the microstrip. Preferably, a high frequency or microwave resistor is used and the contacts are nickel-passivated or otherwise treated to ensure reliable contact. To minimize return loss, the circuit on the flexible microstrip 50 should make suitable contact with the resistor, which in turn makes contact with the ground. Preferably, the grounding should occur in close proximity to the resistor. In this regard, the conductive tab portion 62 extends around the end of the flexible microstrip 50 such that in the patched mode the tab portion contacts the resistor and thus terminates the unpatched equipment port, which in the present example is the port 32. In addition, the ground element 56 of the microstrip 50 comprises a resilient material, which is capable of returning the flexible microstrip 50 back into contact with the conductor pin 34 when the shuttle 44 is moved away from the microstrip, thereby transferring from the patched mode to the normal mode.

Although the foregoing only describes a patch mode using a single patch plug in conjunction with one of the equipment ports, it is also within the scope of the present invention to patch both equipment ports 30, 32 to corresponding patch plugs that are inserted into the patch ports 40, 42 of the jack. When both equipment ports 30, 32 are in the patched mode, both shuttles 44 are fully engaged so that the flexible microstrip 50 has moved away from both conductor pins 34, 36 of the equipment ports 30, 32, respectively. To return one of the equipment ports to the normal mode, for example the equipment port designated by numeral 30, the patch plug is removed from the corresponding patch port 40, which causes the corresponding shuttle 44 to move away from the equipment port and return to its retracted position proximate the back wall 16. As the shuttle 44 moves away from the equipment port 30, the first portion 52 of the flexible microstrip 50 moves away from the termination device 64 and contacts the equipment port. Because the second portion 54 of the microstrip is still in contact with the termination device 64, the equipment port 30 is terminated as described above while the other equipment port 32 remains in the patched mode. To return to the normal mode for both equipment ports 30, 32, both patch plugs must be removed from the respective patch ports 40, 42 so that both portions 52, 54 of the flexible microstrip 50 return to the normal position, as described above. Advantageously, the patch circuits can be repetitively opened and closed while maintaining the impedance of the circuit between the equipment ports 30, 32.

Thus, the present invention provides an electrical coupling and switching device or jack 10 for coaxial applications having a low-loss, low-discontinuity, constant-impedance electrical flowpath for coaxial signals and, when in the patched mode, terminating the unpatched equipment port in a low return loss impedance that is substantially equivalent to the system impedance while the patched equipment port maintains a low-loss and low-discontinuity patched signal. Advantageously, the jack of the present invention has minimal return loss and discontinuity at bandwidths of 1.5 GHz and higher, yet is durable enough to withstand repetitious cycling of the flexible microstrip 50 and associated components from the normal mode to the patch mode and vice versa. As such, the present invention provides a jack and a method of patching a circuit that overcomes the problems mentioned above.

Many modifications and other embodiments of the invention will come to mind to one skilled in the art to which this invention pertains having the benefit of the teachings presented in the foregoing descriptions and the associated drawings. For example, the jack 10 may be designed such that the equipment parts 30, 32 are positioned at an angle, such as 90° or other angle, relative to the patch ports 40, 42, instead of each equipment port having a common longitudinal axis with the respective patch port as illustrated in the drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An electrical coupling and switching device, comprising:

a housing defining first and second equipment ports each having a conductor pin for connection with a center conductor of a respective equipment plug inserted into the equipment port the housing further defining first and second patch ports for receiving first and second patch plugs;

first and second insulative actuators each having a conducting portion and positioned to be engaged by the respective patch plug inserted into the respective patch port and to be urged by the patch plug toward the opposite equipment plug such that a conductor of the patch plug contacts the conducting member of the actuator which in turn contacts the conductor pin of the equipment port so as to establish connection between the patch plug and the equipment port; and a flexible microstrip comprising a conducting track proximate a dielectric layer, the flexible microstrip having first and second portions biased into contact with the conductor pins of the first and second equipment ports, respectively, so as to establish a connection therebetween when no patch plugs are inserted into the patch ports, the insulative actuators and microstrip being structured and arranged such that each actuator urges the respective portion of the microstrip out of contact with the conductor pin on the respective equipment port when the patch plug is inserted into the respective patch port.

2. An electrical coupling and switching device according to claim 1, wherein the microstrip has a substantially constant impedance.

3. An electrical coupling and switching device according to claim 1, wherein the first patch port is positioned opposite the first equipment port, and the second patch port is positioned opposite the second equipment port.

4. An electrical coupling and switching device according to claim 1, wherein the first and second insulative actuators include a ramped surface for gradually engaging the flexible microstrip.

5. An electrical coupling and switching device according to claim 1, wherein the flexible microstrip includes a resiliently flexible material.

6. An electrical coupling and switching device according to claim 1, further comprising a resistive termination device being positioned to be contacted by the microstrip when one of the insulative actuators urges the respective portion of the microstrip out of contact with the conductor pin of the respective equipment port so as to establish electrical contact between the portion of the microstrip and the contact and thereby terminate the other equipment port in the termination device.

7. An electrical coupling and switching device according to claim 6, wherein the resistive termination device is a 75 Ohm resistor.

8. An electrical coupling and switching device according to claim 6, further comprising a conductive tab portion attached to the flexible microstrip for facilitating contact between the microstrip and the resistive termination device.

9. An electrical coupling and switching device according to claim 1, further comprising a resiliently flexible ground element, the dielectric layer being adjacent the conducting track and the ground element being adjacent the dielectric layer, wherein the ground element is capable of returning the microstrip to a first position from a biased second position.

10. An electrical coupling and switching device according to claim 9, wherein the ground element comprises beryllium copper.

* * * * *